US006766655B1

(12) United States Patent
Wu

(10) Patent No.: US 6,766,655 B1
(45) Date of Patent: Jul. 27, 2004

(54) EVAPORATIVE CONDENSER WITHOUT COOLING FINS

(76) Inventor: Ho Hsin Wu, 40-1, Chang Chun Road, I-Lan (TW)

( * ) Notice: Subject to any disclaimer, the term of this patent is extended or adjusted under 35 U.S.C. 154(b) by 0 days.

(21) Appl. No.: 10/685,506

(22) Filed: Oct. 16, 2003

(51) Int. Cl.[7] ..... F28D 5/00

(52) U.S. Cl. ..... 62/305; 62/310; 165/110; 165/900

(58) Field of Search ..... 62/305, 309, 310; 165/110, 900; 261/151, 153, 160

(56) References Cited

U.S. PATENT DOCUMENTS 3,659,623 A * 5/1972 Facius ..... 137/255
4,626,387 A * 12/1986 Dodds ..... 261/153
4,755,331 A * 7/1988 Merrill et al. ..... 261/153
5,724,828 A * 3/1998 Korenic ..... 62/305
6,598,862 B2 * 7/2003 Merrill et al. ..... 261/128

* cited by examiner

*Primary Examiner*—Melvin Jones
(74) *Attorney, Agent, or Firm*—Troxell Law Office PLLC

(57) ABSTRACT

An evaporative type medium condenser without the using of conventional cooling fins comprises: characteristically a plurality of streamline cross sectional bare metal tubes disposed in parallel for medium coils to instead the conventional round sectional tubes thereof; a recycling water supply system having a plurality of water spray nozzles for spraying fine water particles onto the surface of coil tubes formed a water film continuously held thereon; a fan system to provide a wind flow blowing over the streamline tubes in a direction from a large head front portion of the streamline cross section to a gradual reduced rear portion thereof and to provide a low pressure area thereat so as to speedy the evaporation of the water film on the surface of the coils tubes for improving a high cooling efficiency to reach a high E.E.R. therefore.

12 Claims, 8 Drawing Sheets

EVAPORATIVE CONDENSER WITHOUT COOLING FINS

FIELD OF THE INVENTION

The present invention relates to an evaporative type medium condenser of an outdoor apparatus of an air conditioning system without the utilizing of conventional cooling fins especially relates to an evaporative condenser which a plurality of streamline cross section bare metal tubes are used for the medium coils to tack the place of conventional round tube coils for highly increasing the evaporative efficiency by the bare streamline tubes themselves to omit the using of cooling fins so as to thoroughly avoid the possibility of deposit dirt and sediment on the coil tubes between conventional cooling fins to provide the improvement of a long life time and convenient for maintenance and cleaning therefore.

BACKGROUND OF THE INVENTION

The air conditioning system is a very important installation now in daily life of human been, as to save the energy source, a problem of how to improve the E.E.R. of an air conditioning system will be a target of the designers and producers to be reached, therefore the type of heat dissipation for cooling the medium coils is improved from air cooling to water cooling and then tendered to evaporative cooling.

Theoretically, 1 Kg of water absorbs 539 Kcal of latent heat while evaporated, but absorbs only 30 Kcal of heat while the temperature of 1 Kg cooling water be raised 30° C. as a maximum value that a water cooling system can be achieved, the deferent ratio is 18 times.

However, in now a day the most of so called evaporative cooling system in market are not a real evaporating system but a combination of air cooling water cooling and evaporative cooling. Because:

Firstly, there are still conventional round tubes used for medium coils. As shown in FIG. 1A, which a wind flow W blows faced to a leading edge A of a round sectional tube 110 with a layer of water film thereon, divided into two flows around the surface of the tube 110 respectively to point F and F' through two opposite point D and D' of a diameter of the tube 110 as shown by arrow headed lines and then directly blows to a tube 110' of next row of the coils. In that case, a lot of drawbacks will be happened as:

1. The wind flow W dose not blows over a rear portion of the curved surface of an arc FEF' (E is the end edge of the tube110) it's a kind of waste.
2. The eddy currents will be occurred behind the rear edge E and also a windless area will be happened thereat to offer a poor effect to the next row tube 110'.
3. Essentially the evaporation efficiency is not fully developed while the wind flow W blows over the water film on the surface of curved area ADF and AD'F' is under a condition of normal atmosphere pressure.

Secondary, there are still cooling fins used in high density as 13~17 piece per inch, in which there will be water layers full filled the interval between two adjacent fins but no water films occurred on the fins for evaporating therefore it is not a real evaporative system in fact.

FIG. 1B shows a streamline cross sectional tube 120 according to the present invention to instead of the conventional round tube for medium coils which a wind flow W blows headed to a leading edge A of a large head portion of the streamline tube 120 and divided into two opposite path around the surface of tube 120 passing through the diameter DD', respectively to a gradual reduced rear portion of curve DE and D'E', in which, according to theory of aerodynamics, the wind flow W will blows still around the surface DE and D'E' of the reduced area closely, further more, there a rapid acceleration will be occurred to provide a large negative pressure thereon, therefore as a water film kept continuously on the surface of the streamline tube 120 in a wind flow W, it will be evaporated easily even at a room temperature under an extra low pressure (large negative pressure) and a large amount of latent heat of water evaporation (539 cal for evaporating 1 gr of water) will be absorbed from the gaseous state medium in the tube 120 to produce a low temperature thereat, in which a low critical pressure of a medium compressor is need for condensing the low temperature medium from gaseous state into liquid state so as to save energy for improving E.E.R. therefore.

Practically a streamline cross section can be combined with two different ellipses by half and half, which FIG. 2A shown a first ellipse "A" taken from a projection view of a tilt cutting to a round tube R of a diameter D with an obtuse angle $\alpha$, while FIG. 2B shows a second ellipse "B" taken from a projection view cutting to a same round tube R of a diameter D with an acute angle $\beta$, and FIG. 2C is a cross sectional view of a streamline tube combined with a left half of ellipse "A" and a right half of ellipse "B", in which the preferable value of tilt angle $\alpha$ and $\beta$ used in the present invention are;

$$\alpha=60°\pm5°,\ \beta=25°\pm5°$$

In FIGS. 2A, 2B and 2C, actually $\alpha=60°$, $\beta=25°$.

Further more, a streamline cross section is different from a cross section of a symmetrical aerofoil, which a symmetrical aerofoil section tube as shown in the figures of the prior arts of U.S. Pat. No. 3,885,936 and Japan patent 63,096,490 there a rear end of the tube is a narrow sharp angular form, while a rear end of a streamline cross sectional tube of the present invention as shows in FIG. 1B is characteristically formed of an end portion of an ellipse with a convex curve to avoid a narrow sharp angular edge inside the tube, a narrow sharp angular form inside the tube may do nothing for a regular heat exchanger as claimed in the foresaid prior arts, but there will be a serious drawback for using to a medium condenser, because there will be a large amount of pressure drop occurred due to a high friction loss when the medium flow runs in the narrow sharp angular portion inside the tube, in which , an extra power of a medium compressor is needed for recovering the loss of pressure drop, the E.E.R. then can not be improved therefore.

FIG. 3 shows another embodiment of a streamline tube may used in the present invention which a streamline tube 120 has a tail fin 122 extended from a rear end edge for increasing the heat dissipation rear therefore.

SUMMARY OF THE INVENTION

The present invention is a mew design according to the theory of aerodynamics to solve all the foresaid drawbacks of the conventional medium condensers.

Therefore, a main object of the present invention is to provide a medium condenser composed of a plurality of streamline cross section bare metal tubes to improve a high evaporative heat dissipation efficiency according the theory of aerodynamics.

Another main object of the present invention is to provide a medium condenser without the using of conventional cooling fins to avoid the deposit dirt and sediment on the coil tubes between conventional cooling fins so as to maintain a long life time therefore.

Still another object of the present invention is to provide a medium condenser without conventional cooling fins for saving the cost and work of manufacturing, and convenient for maintenance and cleaning.

BRIEF INTRODUCTION OF THE DRAWINGS

FIG. 1A showing a wind flow blows over a round tube.

FIG. 1B showing a wind flow blows over a streamline cross sectional tube according to aerodynamics.

FIGS. 2A, 2B and 2C showing a streamline cross section composed from two different ellipses.

FIG. 3 showing a streamline tube having a tail fin extended from a rear edge.

DETAIL DESCRIPTION OF THE PRESENT INVENTION

Figure 1A:
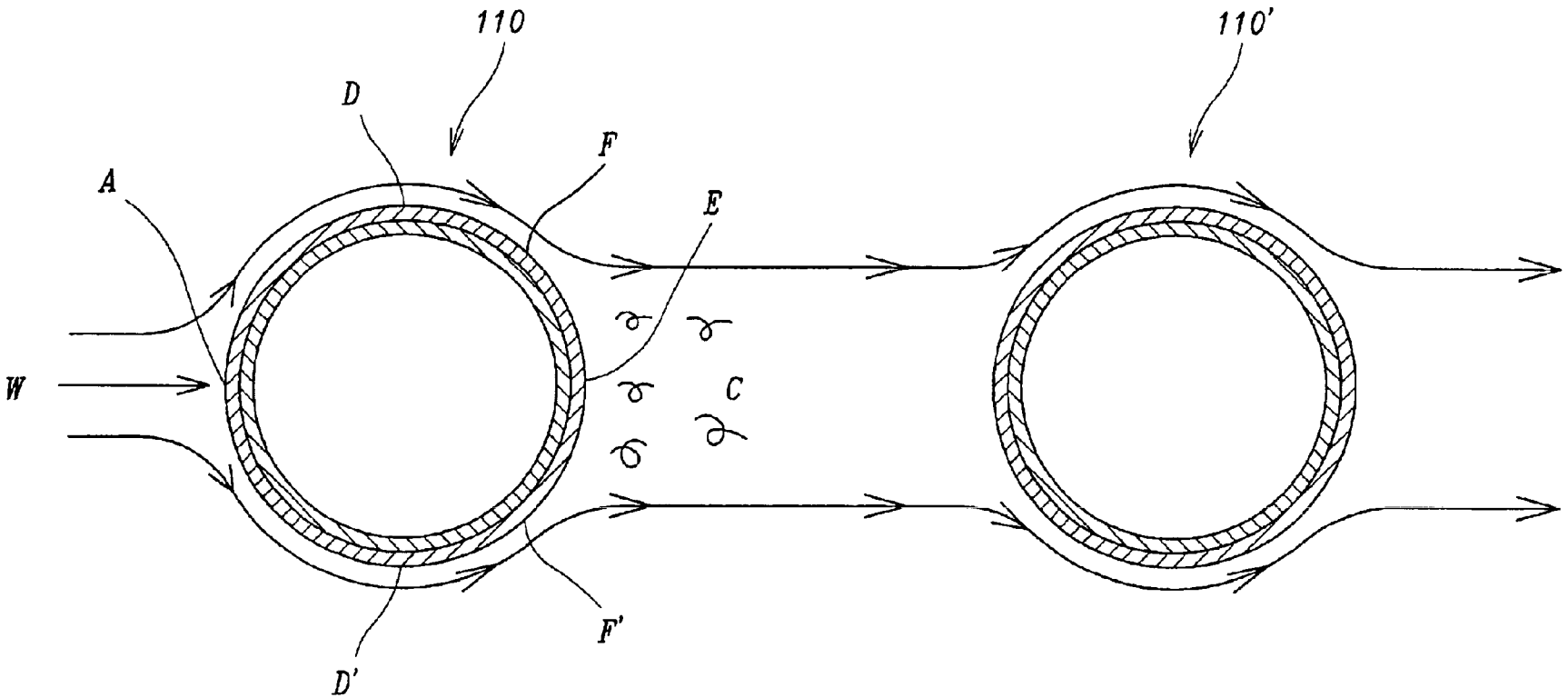
Figure 1B:
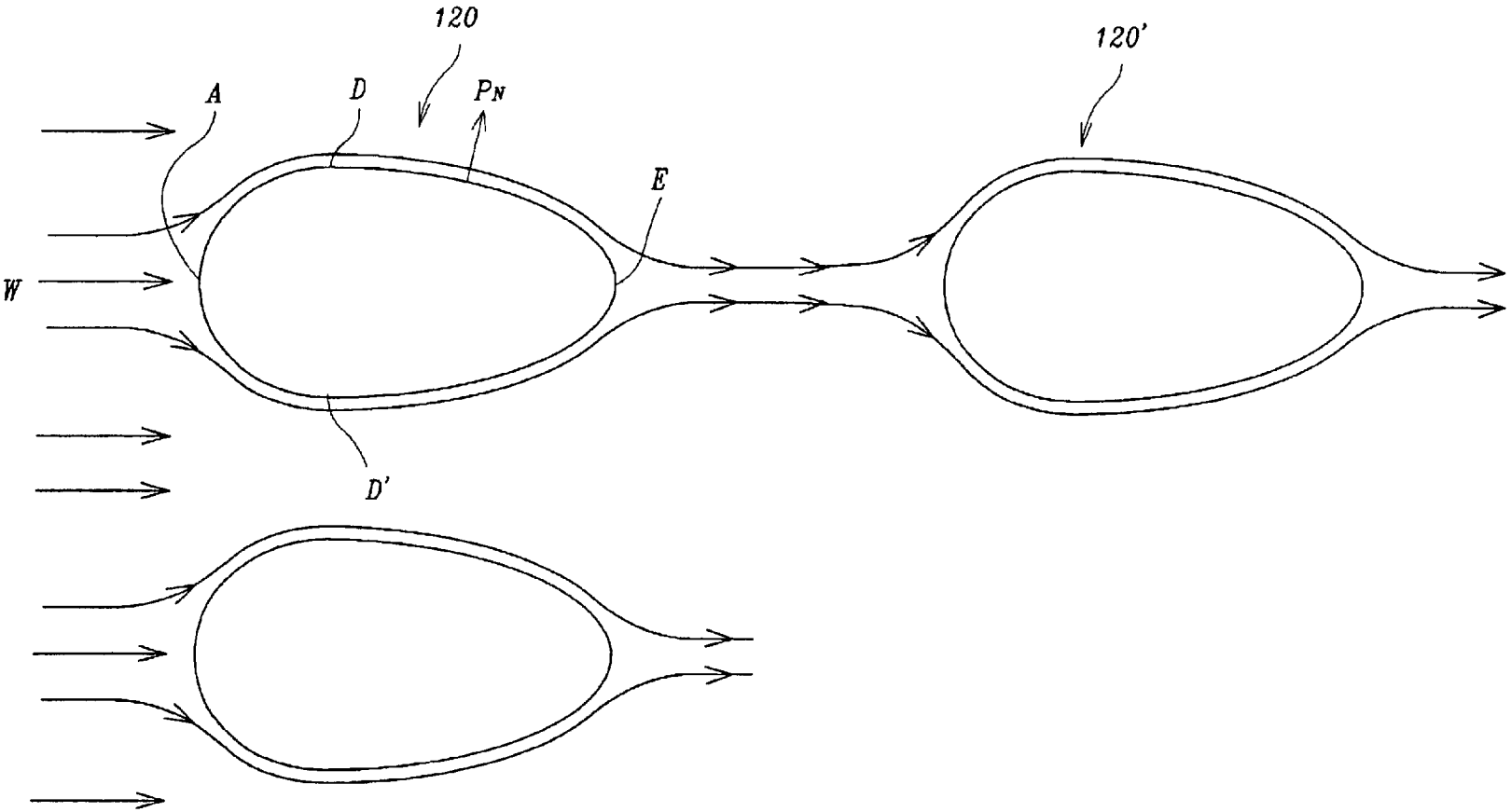
Figure 2A:
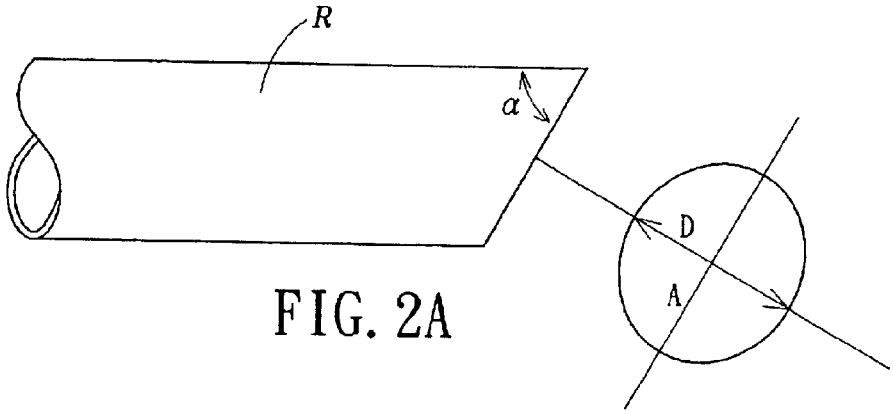
Figure 2B:
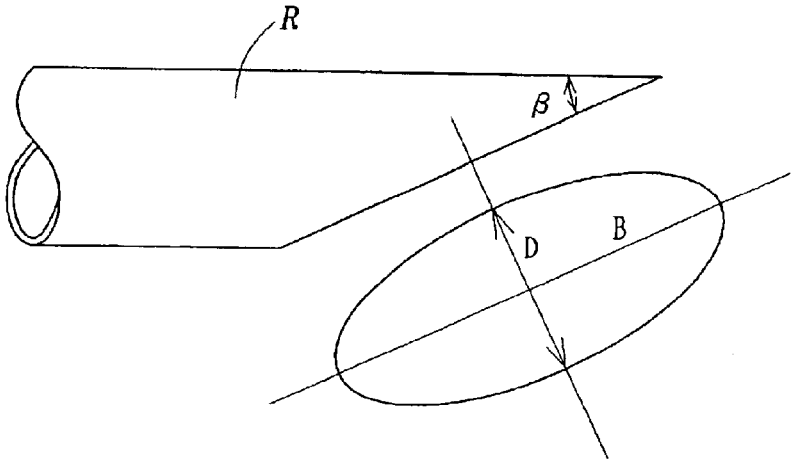
Figure 2C:
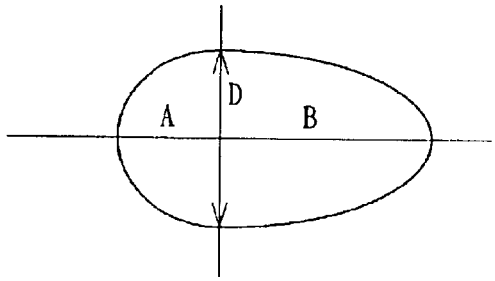
Figure 3:
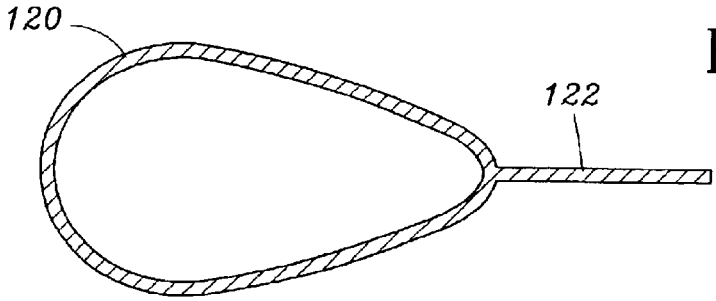
Figure 4:
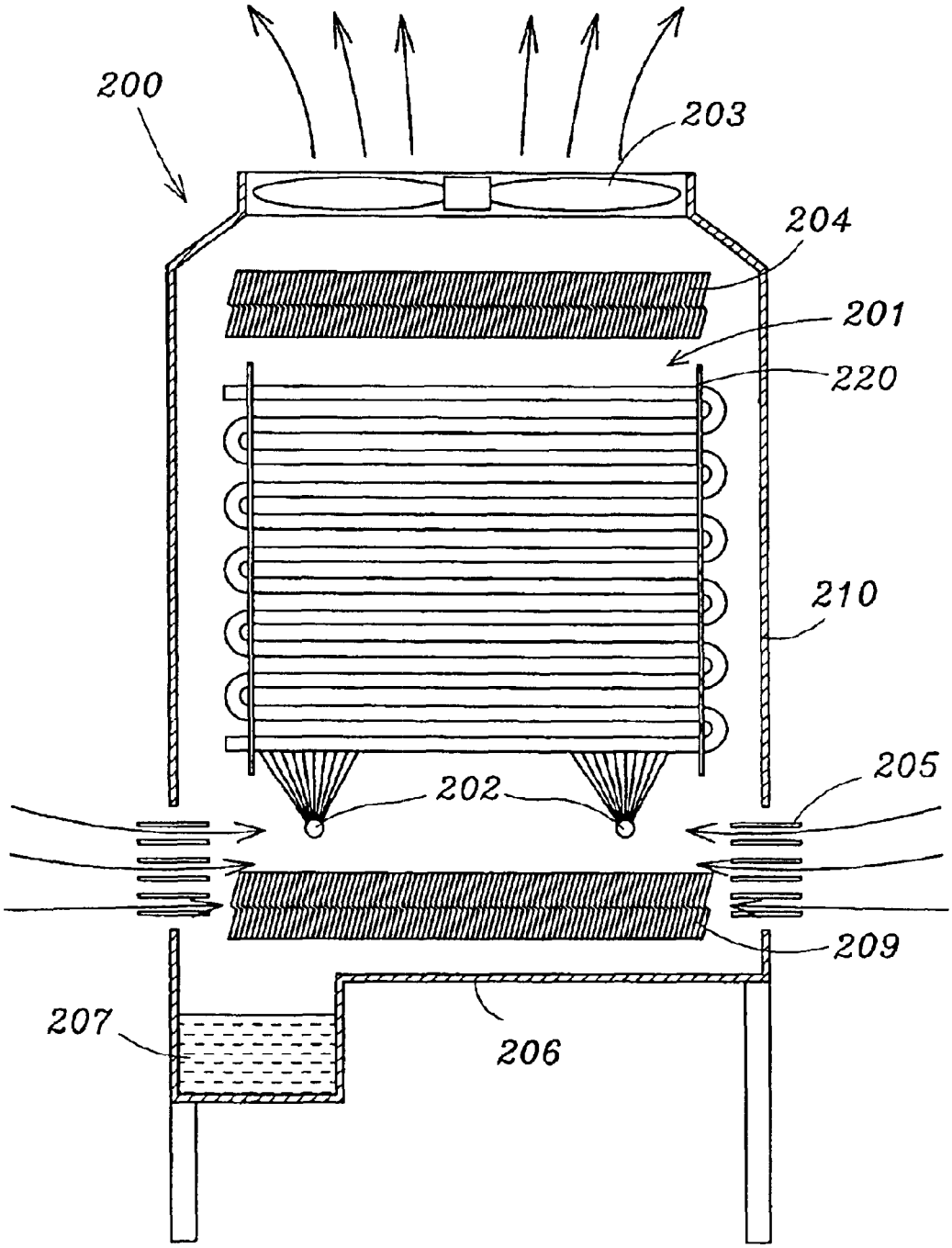
FIG. 4 is a front view of a preferable embodiment of an upward blow type evaporative condenser according the present invention.
Figure 4A:
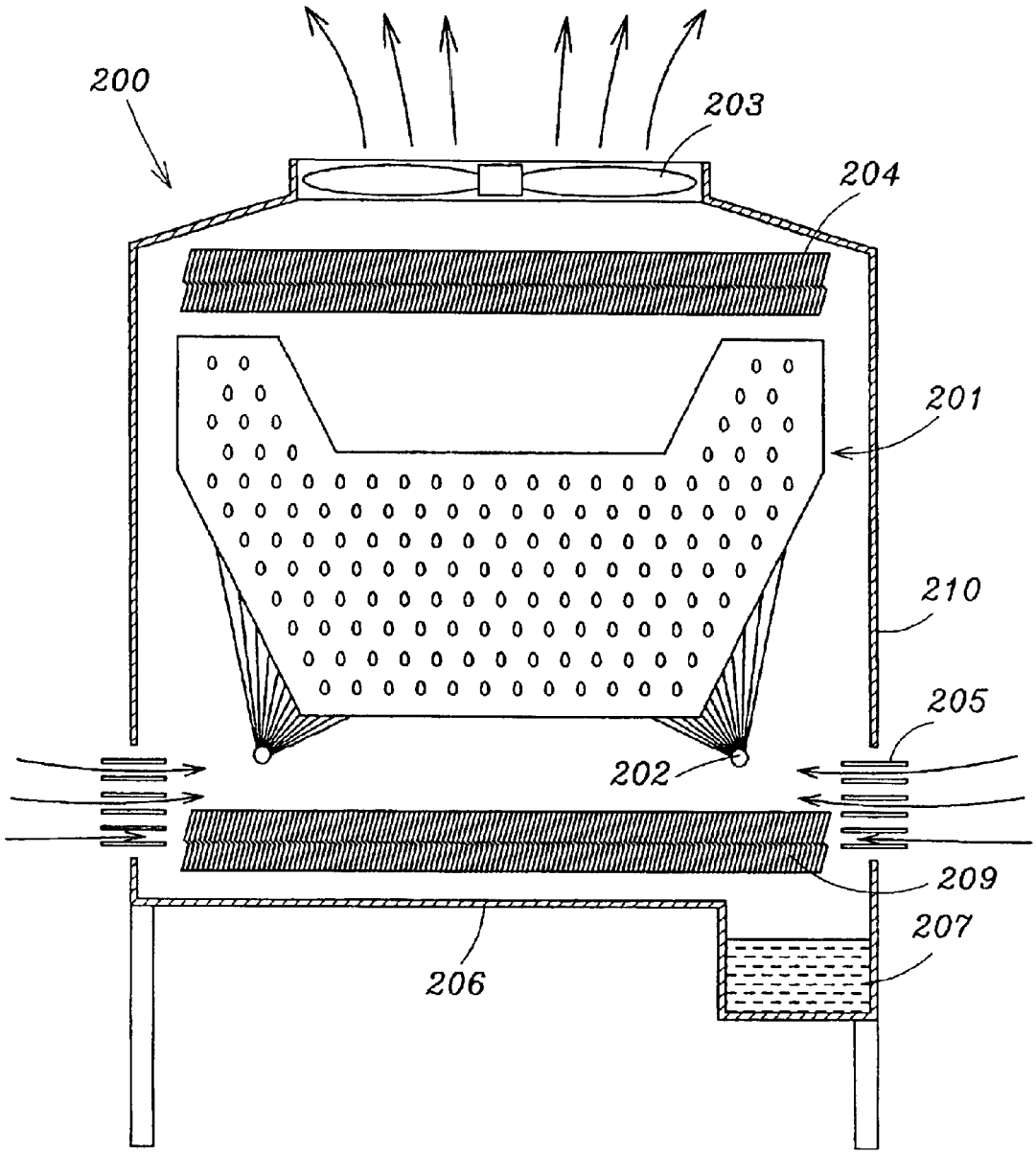
FIG. 4A is a side view of FIG. 4.

Referring to FIGS. 4 and 4A, a preferable embodiment of an upward flow type evaporative condenser 200 according to the present invention comprise a basin typed medium coil set 201 composed of a plurality of parallel streamline tubes laterally fixed on two opposite supporting plate 220 having their head portion toward downwardly for receiving water-fog partials sprayed upwardly from a plurality of water spray nozzles 202 there under to supply a water film continuously on to the surfaces of the tubes; at least one fan 203 of a wind flow supply system disposed at an outlet opening at a top of an overall casing 210 to draw the wind flow from a plurality of shutters 205 around the casing 210 upwardly for exhausting the heat and evaporated moisture out therefrom, while the wind flow sweep over the water films on the surfaces of the streamline tubes 208, the water films will be evaporated rapidly at a room temperature under a circumstance which a large negative pressure is occurred thereat, therefore a large amount of evaporative latent heat will be absorbed from the gaseous state medium flow in the coil tubes to reach a very low temperature, in which the medium can be easily condensed by a considerable low critical pressure so as to save consumptive power of a medium compressor for achieving to a high E.E.R. therefore; a gas-water separating layer 204 composed of thin plastic pieces disposed under the fan 203 over the coil set 201 for separating water particles from hot air and moisture before exhausting, a water collecting pan 206 disposed under the coil set 201 for collecting residual water dropt thereinto; a water reservoir 207 disposed under one side of the water collecting pan 206 having a small size high pressure water pump (not shown) pumping water to the water spray nozzles 202, and a floating valve (not shown) to control a city water inlet (not shown) to maintain a proper constant water level in the water reservoir 207; a recycling water temperature reducing layer 209 composed of a plurality irregular-faced plastic fins disposed over the water collecting pan 206 for cooling the residual water to avoid an accumulation of temperature raising of water in a recycling system therefore.

Figure 5:
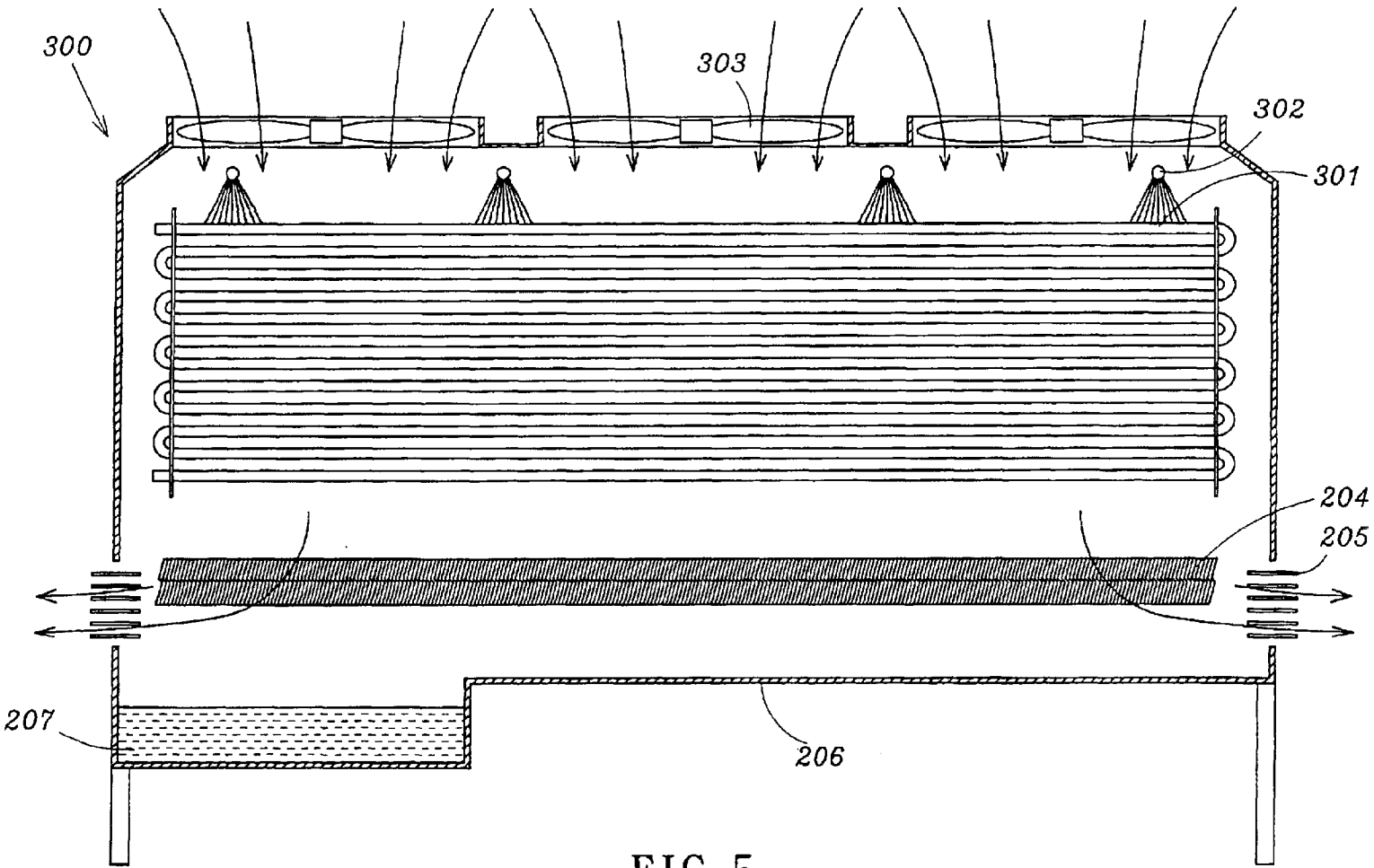
FIG. 5 is a front view of another preferable embodiment of a downward blow type evaporative condenser according to the present invention.
Figure 5A:
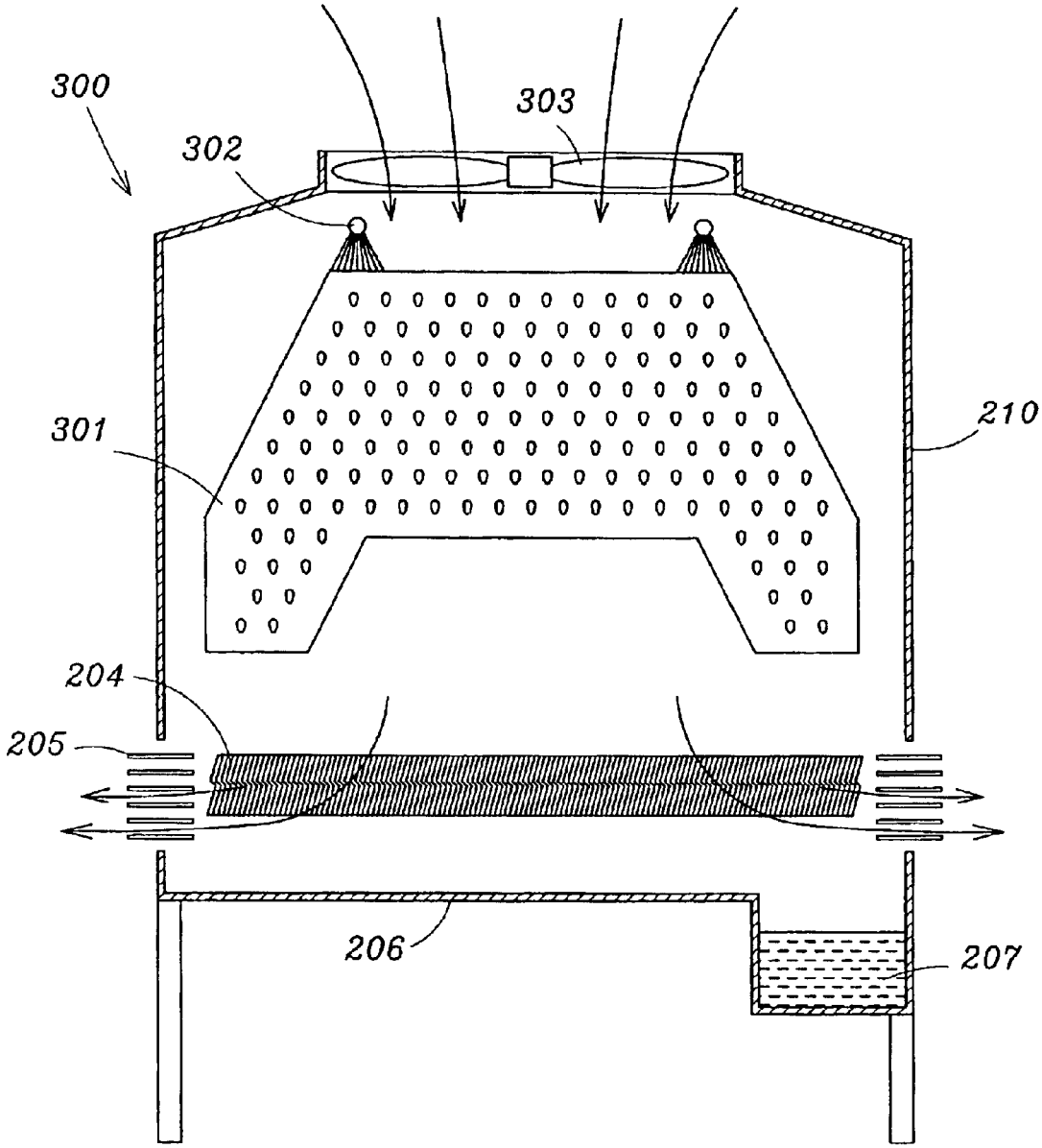
FIG. 5A is a side view of FIG. 5.

Referring to FIG. 5 and FIG. 5A, a preferable embodiment of a downward blow type evaporative condenser 300 according to the present invention, which the only difference from a upward flow type embodiment as shown in FIG. 4 and FIG. 4A is that the direction of the wind flow is reversed blown downwardly from the fans 303 in the openings at atop of the casing 210 and to exhaust the heat and moisture from the shutters 205, therefore a coil set 301 of streamline tubes is also in a reversed form with a large head portion of streamline tube upwardly to against the downward wind flow; a plurality of water-fog spray nozzles 302 disposed on an upside over the coil set 301 under the fans 303, and a gas-water separating layer 304 disposed under the coil set 301 to separate and cooling the residual water to the collecting pan 206 of a recycling system as aforesaid description to FIG. 4 and FIG. 4A.

Figure 6:
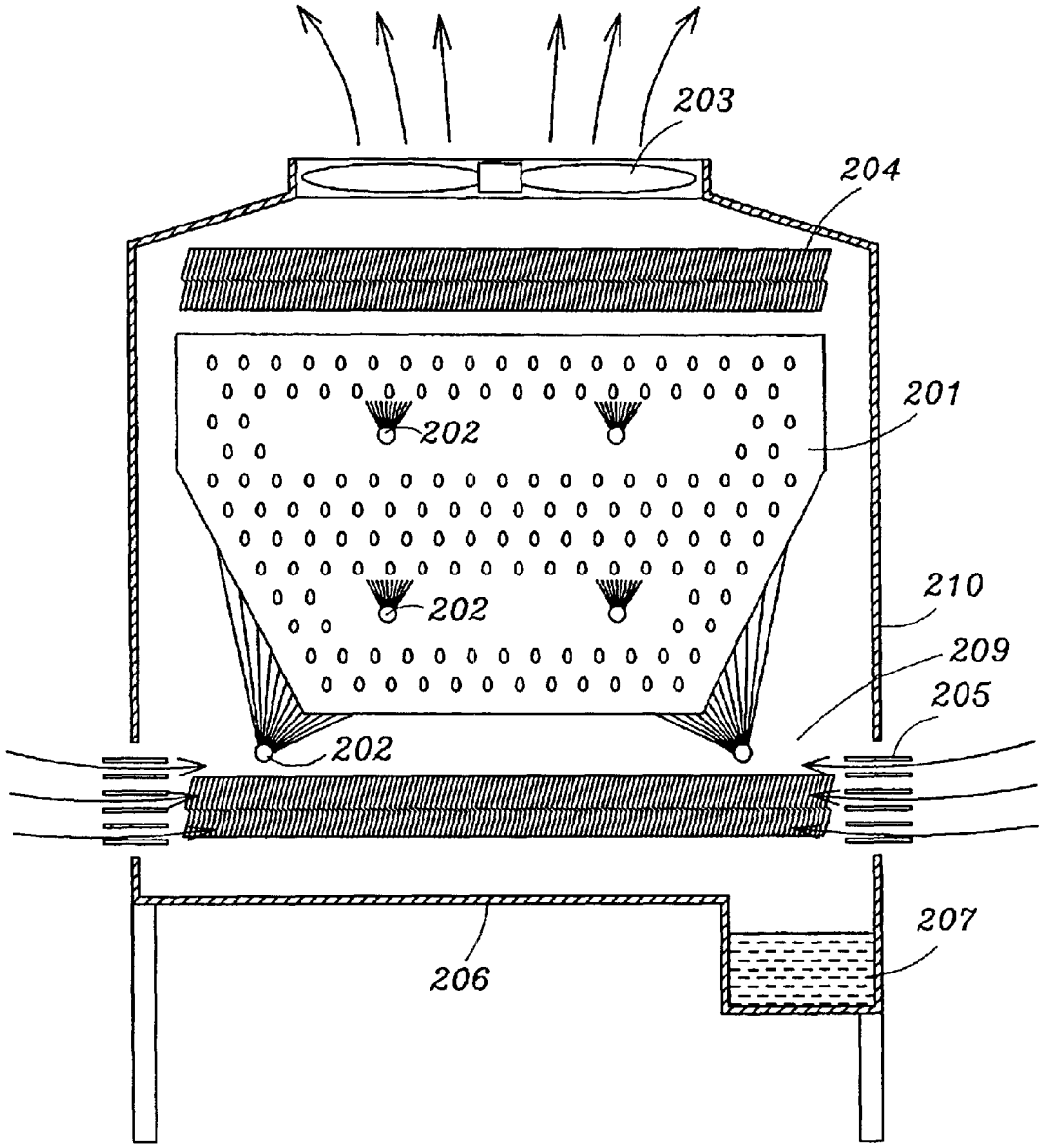
FIG. 6 is a side view to show additional water spray nozzles inserted into the interval of coil tubes.

Finally, referring to FIG. 6. Another preferable embodiment of the present invention having a large size coil set 201, which a plurality of additional water-fog spray nozzles 202 are inserted into the intervals between the layers of coil tube of a coil set 201 to increase the efficiency of evaporation by spray proper water film onto the surface of streamline tube therefore.

It is clear, that those figures are just for showing some kinds of preferable embodiments of the present invention in an upward blow type and a downward blow type, but not to state the limitation thereof, other designations such as lateral blow type, tilted blow type etc. evaporative medium condensers which used streamline tubes without cooling fins are certainly included therefore.

What is claimed is:

1. An evaporative condenser without cooling fins comprises:

a medium coil body including a plurality of lateral streamline cross sectional bare metal tubes parallel fixed on two supporting plates at two opposite ends of said tubes, which said streamline cross sectional tube has a front head portion and a rear tail portion;

a water supply system to provide a water film continuously to the surface of said coil tubes;

a wind system to provide a wind flow in a direction headed to said front head portion thoroughly over the surface of said rear tail portion of said streamline tubes to evaporating said water film rapidly so as to absorb a large amount of latent heat of water evaporating, in which types of wind systems are classified by the direction of wind flow, namely upward blow type, downward blow type, lateral blow type and tilt blow type.

2. An evaporative condenser according to claim 1, wherein said front head portion of said streamline tube with a cross section has a shorter and gradually enlarged form while said rear tail portion has a longer and gradually reduced form.

3. An evaporative condenser according to claim 1, wherein said streamline cross sectional tube has a tail fin extended from a rear edge of said rear tail portion thereof.

4. An evaporative condenser according to claim 1, wherein said water supply system comprises:

a plurality of water spray nozzles for spraying fog-like water particles onto the surface of said coil tubes continuously;

a water collecting pan disposed under said medium coil body to collecting residual water drops not be evaporated on time;

a water reservoir to receive the residual water from said water collecting pan having a floating valve to control an inlet of city water for maintaining a predetermined water level therein and a small-sized high pressure pump to feed water or said spray nozzles therefore.

5. An evaporative condenser according to claim 1, wherein said upward-blow type apparatus is comprised of:

a plurality of said streamline tubes of said medium coil body having their front head portion headed to a downward direction;

at least one of said water spray nozzle disposed under said medium coil body to spray water particles upwardly onto the surface of streamline tubes;

at least one of exhaust fan of said wind system disposed in an outlet opening at a top to draw the wind upwardly passing through said medium coil body to speed up the evaporation of water on the surface of said streamline tubes and to exhaust the heat and hot air there from.

6. An evaporative condenser according to claim 1, wherein said downward-blow type apparatus is composed of:

a plurality of streamline tube of said medium coil body having their front head portion headed to a upward direction;

at least one of said water spray nozzle disposed on a top over said medium body spraying water particles downwardly onto the surface of said streamline tubes and formed water films thereon;

at least an electrical fan of said wind system disposed in an air inlet opening at a top to supply wind downwardly passing through said streamline tubes from said front head portion over said rear reduced portion thereof.

7. An evaporative condenser according to claim 5, wherein said wind system further comprises an air-water separating layer of plastic pieces disposed under said exhaust fan to separate the water particles from air thereat.

8. An evaporative condenser according to claim 6, wherein said wind system further comprises: an air-water separate layer of plastic pieces disposed under said medium coil body for separating the residual water particles from air and steam thereat.

9. An evaporative condenser according to claim 4, wherein said water supply system are additionally disposed in said medium coil body between layers of streamline tubes for supply water particles layers be layers.

10. An evaporative condenser according to claim 4, wherein said water supply system further comprises a residual water heat exchanger for cooling the residual water before collected to said water collecting pan to avoid an accumulating of temperature raising of recycling water.

11. An evaporative condenser according to claim 10, wherein said residual water heat exchanger is composed of a plurality of vertical layers of plastic fins.

12. An evaporative condenser according to claim 11, wherein said plastic fins of said heat exchanger have their surface in a concave and convex irregular form.

* * * * *